United States Patent [19]

Bégué

[11] 4,326,398

[45] Apr. 27, 1982

[54] APPARATUS TO EQUALIZE IN HEIGHT, BY HAMMERING, THE LINE OF WELDING OF LONGITUDINALLY WELDED TUBES

[75] Inventor: Bernard Bégué, Pavillon sous Bois, France

[73] Assignee: Vallourec, Paris, France

[21] Appl. No.: 102,758

[22] Filed: Dec. 12, 1979

[51] Int. Cl.[3] ..... B21J 7/04

[52] U.S. Cl. ..... 72/193; 72/370; 228/125

[58] Field of Search ..... 72/193, 370; 228/125; 29/33 A

[56] References Cited

U.S. PATENT DOCUMENTS

| | | | |
|---|---|---|---|
| 3,494,165 | 2/1970 | Preusch | 72/193 |
| 3,877,283 | 4/1975 | Hohl et al. | 72/193 |
| 3,911,710 | 10/1975 | Gest | 72/193 |

*Primary Examiner*—Lowell A. Larson
*Attorney, Agent, or Firm*—Brisebois & Kruger

[57] ABSTRACT

An apparatus for flattening the weld bead of longitudinally welded tubes consisting of a hammering mass impacting with a frequency greater than 2500 impacts per minute and an anvil having an elastomer bushing at each end.

7 Claims, 3 Drawing Figures

Figure 1:
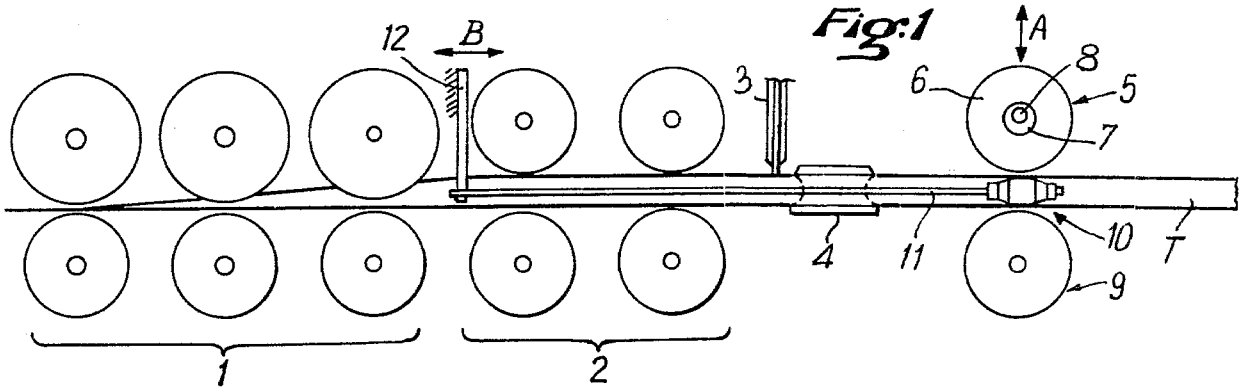

12
B
3
A
8
6
5
7
4
11
10
T
9
1
2

10
10a
19
20
17
14
21
10b

5
A
8
6
7
A
10
14
17
11
16
10a
15
13
19
10b
10b
19
18
9

APPARATUS TO EQUALIZE IN HEIGHT, BY HAMMERING, THE LINE OF WELDING OF LONGITUDINALLY WELDED TUBES

The present invention relates to an apparatus to equalize in height or flatten, by hammering, the weld bead or line of longitudinally welded tubes.

It has long been known to produce metal tubes, particularly of steel, by longitudinal welding.

Likewise, different teachings are known to equalize in height or eliminate the line or bead of welding which is formed during the welding process. Thus for tubes of large diameter one proceeds in general by flattening the bead.

For tubes of smaller diameter one uses the technique of hammering by placing in the inside of the tube an anvil, mounted at the end of a rod passing through the tube and adjustable in longitudinal position, whose exterior surface comes in contact against the internal wall of the tube, the hammering being carried out by an external weight actuated either mechanically, pneumatically, or electro-pneumatically. On the opposite side from the hammering weight, the tube is supported by a support element such as a roller mounted for free rotation.

From French Pat. No. 746,189 a hammering device is known using as a hammering mass a disc driven in rotation and provided with a plurality of hammers consisting of eccentric plates placed around the rim of the disc.

From U.S. Pat. No. 3,494,165, a hammering mass is known consisting of a disc mounted eccentrically whose rotation causes a sequential compressive force by the disc on the tube, the anvil or plug placed inside the tube then being driven axially.

At the speeds of rotation of the hammering disc used in such an apparatus, on the order of 200 to 1000 t/mn, the contact of the anvil with the interior weld bead lasts long enough to cause an appreciable drag on the anvil by the tube. It is then necessary, as described in U.S. Pat. No. 3,494,165 and which is an essential characteristic of it, to provide spring means, in the form of a spring, to draw the plug back after each of its longitudinal displacements caused by the rotation of the hammering disc.

This phenomenon of driving the anvil or plug, despite internal lubrication, fatigues the material, and causes violent vibrations which may travel as far as the torch used for welding, creating seizing marks which reduce the quality of the tube produced, lowering its value.

Up to the present it has not been possible to increase the hammering frequency by increasing the speed of rotation of the hammering disc due to the increase in vibrations, inherent in the increase of speed, and particularly the increase in the noise level of the installation.

The present invention proposes a device which, while using a hammering mass, moved at high frequency, specifically a hammering disc rotating at high speed, eliminates the above-mentioned disadvantages at low frequency of reducing the quality of the tube, surprisingly does not cause the harmful effects of unacceptable vibrations and noises.

The device according to the invention is characterized essentially by the fact that it consists of a hammering mass moved so as to present an impact frequency greater than 2500 impacts/minute and that the anvil comprises axially at each end, an elastomer bushing.

The elastomer used preferably has a Shore A hardness of between 91 and 98. In particular the elastomer known under the commercial name of ELADIP may be used. The hammering mass is preferably but not necessarily a rotatable disc operated in sequential hammering movement transmitted by a rotating eccentric around which it is mounted.

The anvil used within the scope of the invention may advantageously have a central cylindrical bearing surface extended axially on each end by a truncated bearing surface whose diameter decreases from the central bearing surface, the two truncated bearing surfaces themselves being extended by elastomer bushings which usefully have a cylindrical shape with a diameter basically equal to that of the end of the truncated bearing surfaces of the anvil. The assembly consisting of the anvil and the elastomer bushings is mounted so as to bear on a metal washer welded to the holding rod of the anvil, the assembly also being axially immobilized on the rod by a fastening means, such as a nut, near the end of the rod.

The device according to the invention may be placed on a production line with the welding machine, or off line. The device according to the invention may, in particular, be used for making welded stainless steel tubes by the TIG process.

A welding production line of the type able to include the device according to the invention can have a plurality of rollers to form a tube from a metallic strip, and a welding station, particularly of the type having a TIG torch and welding rollers.

Figure 3:
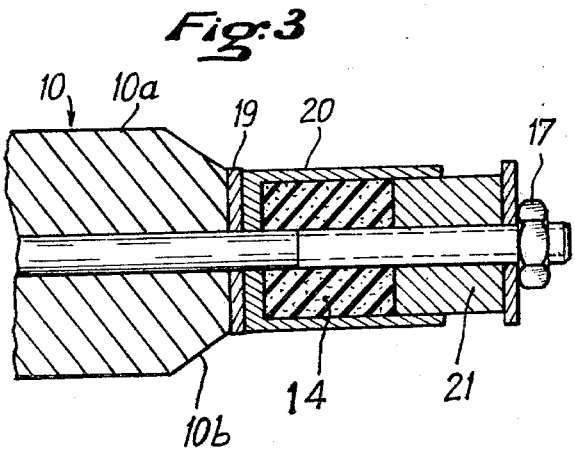
Figure 2:
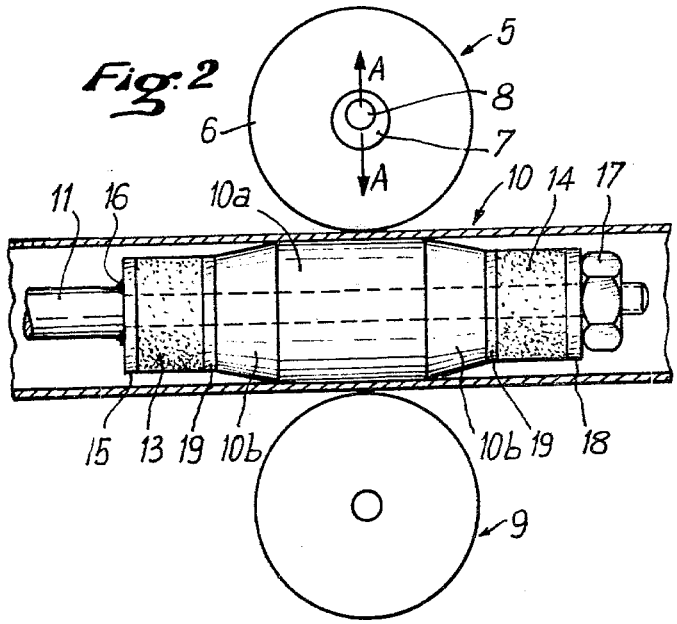

Other advantages and characteristics of the invention will become apparent on reading the following description of one particular embodiment, referring to the attached drawings, in which:

FIG. 1 shows schematically a welding line including the apparatus according to the invention, FIG. 2 shows the apparatus according to the present invention in more detail, and FIG. 3 shows schematically in section a variation of the mounting for the elastomer element of FIG. 2.

The drawings show a conventional welding line having a plurality of pairs of rollers designated generally by 1 and 2, for forming a tube T from a metallic strip, such as in particular, stainless steel.

After having been formed, the tube passes to a welding station having a torch 3, in particular of the TIG type, and welding rollers schematically shown at 4.

The tube thus formed has an internal longitudinal weld bead whose height must be equalized.

For this purpose one places at the end of the welding line apparatus according to this invention, which has a hammering mass 5 driven in a repetitive hammering movement against the external wall of the tube as shown schematically on FIGS. 1 and 2 by arrows A.

This hammering mass 5 could for example be, as described in U.S. Pat. No. 3,494,165, a disc 6 mounted to rotate freely around a cylindrical element 7 which is driven eccentrically by a rotating shaft 8.

According to the invention the hammering mass has an impacting frequency above 2,500 impacts/minute, this frequency being in actual practice, above 3,000 impacts/minute.

Opposed to the hammering mass 5, the apparatus according to the invention has a support roller 9 mounted for free rotation.

The apparatus according to the invention has inside the tube an anvil designated generally by 10, mounted at the end of a holding rod 11 which is attached at its other end to a mechanism 12 shown schematically on FIG. 1, and permitting the axial adjustment of the anvil 10, the axial displacement of the rod 11 under the action of the positioning mechanism 12 being shown schematically by arrow B.

As is shown more clearly on FIG. 2, the anvil according to the invention has a central cylindrical bearing surface 10*a* extended at its ends by two truncated surfaces 10*b*.

The surface 10*b* themselves are extended by two bushings 13 and 14, cylinders of elastomer, such as ELADIP.

The retention of the plug 10 and the elastomer bushings 13 and 14 on rod 11 is accomplished partly by metallic disc 15, welded at 16, to the rod and partly by a nut 17, screwed onto the end of the bar threaded for this purpose, and pressing against the bushing 14 with an intervening metallic washer 18. A metallic washer 19 may also be placed between the plug 10 and each bushing 13 and 14.

In one embodiment the central bearing surface of the anvil has an axial length of 10 mm, the truncated surfaces 10*b* an axial length of 6 mm, and the bushings 13 and 14 an axial length of 15 mm.

In the assembly variation shown at FIG. 3, the bushing 14 is mounted inside a sleeve 20 and held in place by a clamp plug 21. This assembly could also be used for the bushing 13. One avoids thus the distention of the elastomer and the risk of wedging the bushing in the tube.

Under the action of the repeated blows delivered by the repetitive vertical movement of the hammering mass 5, the weld bead of the tube T is worked between the rim of the disc 6 and the plug 10, the assemblage being supported by the support roller 9.

Because of the high frequency according to the invention, the contact of the plug with the line of welding lasts for too short a time to cause drag on the plug by the tube as has been the case in previous devices, notably that described in U.S. Pat. No. 3,494,165.

It has been demonstrated that in carrying out the present invention, one has obtained tubes of excellent quality while assuring quiet operation of the hammering device.

Although not shown in the drawings, it is contemplated to provide means to vary or change the separation between the hammering weight 5 and the support roller 9 to allow adjustment of the final height which one wishes to give to the line of welding.

One will also understand that the particular arrangement of the hammering weight shown on FIGS. 1 and 2 is only one of the numerous possibilities foreseen by the scope of the invention, under the condition that the means to provide the hammering frequency have the minimum values described in the specification.

It is equally evident that numerous modifications of the device could be carried out without departing from either the scope or the spirit of the invention.

I claim:

1. A device to equalize in height, by hammering, the bead of welding of tubes welded longitudinally having inside the tube an anvil mounted on the end of a rod passing through the tube, adjustable in longitudinal position, whose exterior surface comes in contact with the internal wall of the tube, an external hammering mass operated with a successive vertical movement, and a support member mounted opposite the hammering mass, the improvement comprising, means for moving the hammering mass at an impact frequency greater than 2,500 impacts/minute, an elastomer bushing axially at each end of and engaging said anvil, for restraining said anvil against axial movement in either direction, and means for preventing axial displacement of said bushings along the rod.

2. A device according to claim 1, wherein the bushings are made of an elastomer having a Shore A hardness of between 91 and 98.

3. A device according to claim 1 or 2, wherein the anvil has a central cylindrical external bearing surface extended axially on each end by two external truncated bearing surfaces whose diameters decrease from the central bearing surface.

4. A device according to claim 3, characterized by the fact that the elastomer bushings have a cylindrical shape with a diameter basically equal to that of the end of the truncated bearing surfaces of the anvil.

5. A device according to claim 4 further comprising, first and second stop means fixed to said rod on opposite ends of said anvil and bushings and engaging with respective bushings.

6. A device according to claim 1, wherein the hammering mass comprises, a disc mounted for rotation on an eccentric driven by a shaft, said means for moving the hammering mass at a frequency greater than 2,500 impacts/minute comprises means for rotating said shaft at a speed greater than 2,500 rpm, and an idler back up roller engaging the tube at a location diametrically opposite said disc.

7. A method of equalizing or flattening a weld bead of a longitudinally welded metal tube comprising, hammering the outside of said tube at the bead with a hammering mass at an impact frequency greater than 2,500 impacts/minute while maintaining within the tube an anvil restrained against axial movement by an elastomer bushing at each of its ends.

* * * * *

UNITED STATES PATENT AND TRADEMARK OFFICE

CERTIFICATE OF CORRECTION

PATENT NO. : 4,326,398

DATED : April 27, 1982

INVENTOR(S) : BERNARD BEGUE

It is certified that error appears in the above—identified patent and that said Letters Patent is hereby corrected as shown below:

On the title page add:

[30] Foreign Application Priority Data

Dec. 18, 1978 France.....78.35557

Signed and Sealed this

*Fifteenth* Day of *June 1982*

[SEAL]

*Attest:*

GERALD J. MOSSINGHOFF

*Attesting Officer* *Commissioner of Patents and Trademarks*